US010029875B2

(12) United States Patent
Ratz et al.

(10) Patent No.: US 10,029,875 B2
(45) Date of Patent: Jul. 24, 2018

(54) WINDING DEVICE FOR WINDING A WEB-SHAPED MATERIAL AND METHOD FOR CHANGING A REEL IN A WINDING DEVICE

(71) Applicant: WINDMÖLLER & HÖLSCHER KG, Lengerich (DE)

(72) Inventors: Gerd Ratz, Lienen (DE); Christian Heumann, Osnabrueck (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 96 days.

(21) Appl. No.: 15/029,364

(22) PCT Filed: Oct. 15, 2014

(86) PCT No.: PCT/EP2014/072094

§ 371 (c)(1),
(2) Date: Apr. 14, 2016

(87) PCT Pub. No.: WO2015/055703

PCT Pub. Date: Apr. 23, 2015

(65) Prior Publication Data

US 2016/0236887 A1 Aug. 18, 2016

(30) Foreign Application Priority Data

Oct. 15, 2013 (DE) ..... 10 2013 220 856

(51) Int. Cl.

| | |
|---|---|
| ***B65H 18/10*** | (2006.01) |
| ***B65H 19/30*** | (2006.01) |
| ***B65H 19/22*** | (2006.01) |

(52) U.S. Cl.

CPC ..... *B65H 19/30* (2013.01); *B65H 18/10* (2013.01); *B65H 19/2238* (2013.01); *B65H 19/305* (2013.01); *B65H 2301/4181* (2013.01); *B65H 2301/41812* (2013.01); *B65H 2301/41829* (2013.01); *B65H 2513/108* (2013.01); *B65H 2513/212* (2013.01)

(58) Field of Classification Search

CPC ..... B65H 18/10; B65H 19/30; B65H 19/305; B65H 19/2238

See application file for complete search history.

(56) References Cited

U.S. PATENT DOCUMENTS

| | | | |
|---|---|---|---|
| 4,979,689 | A | 12/1990 | Snygg |
| 5,577,685 | A | 11/1996 | Junk |

(Continued)

FOREIGN PATENT DOCUMENTS

| | | |
|---|---|---|
| CA | 2456528 | 3/2003 |
| CN | 1040005 | 2/1990 |

(Continued)

*Primary Examiner* — Sang K Kim

(74) *Attorney, Agent, or Firm* — Jacobson Holman, PLLC.

(57) ABSTRACT

A winding device for winding a web-shaped material, preferably a plastic film, has a reel for receiving the web-shaped material, a contact roller for feeding and pressing the web-shaped material against the reel, a device for rotationally driving a still empty reel, and a device for feeding the still empty reel to the contact roller. The device for rotationally driving the still empty reel and the device for feeding the still empty reel to the contact roller can act simultaneously on the still empty reel.

17 Claims, 2 Drawing Sheets

(56) References Cited

U.S. PATENT DOCUMENTS

| | | | | |
|---|---|---|---|---|
| 5,816,528 | A | 10/1998 | Ekstrom et al. | |
| 5,845,868 | A * | 12/1998 | Klerelid | B65H 18/26 242/541 |
| 6,536,704 | B1 | 3/2003 | Rautakorpi et al. | |
| 6,550,713 | B1 * | 4/2003 | Ruha | B65H 18/26 242/534 |
| 6,834,824 | B1 * | 12/2004 | Smith | B65H 18/16 242/530.1 |
| 7,168,651 | B2 | 1/2007 | Markkanen et al. | |
| 7,469,856 | B1 | 12/2008 | Tsai | |
| 2007/0057109 | A1 | 3/2007 | Reinhold | |

FOREIGN PATENT DOCUMENTS

| | | |
|---|---|---|
| DE | 8233799 | 7/1983 |
| DE | 4415316 | 11/1995 |
| DE | 4415324 | 11/1995 |
| DE | 19702715 | 7/1998 |
| DE | 69712354 | 11/2002 |
| DE | 20117248 | 4/2003 |
| DE | 69915339 | 7/2004 |
| DE | 60223417 | 9/2008 |
| DE | 10297181 | 1/2015 |
| EP | 1306335 | 5/2003 |
| GB | 2249542 | 5/1992 |

* cited by examiner

WINDING DEVICE FOR WINDING A WEB-SHAPED MATERIAL AND METHOD FOR CHANGING A REEL IN A WINDING DEVICE

CROSS-REFERENCE TO RELATED APPLICATION

This is a U.S. national stage application of PCT/EP2014/072094 filed Oct. 15, 2014.

BACKGROUND OF THE INVENTION

1. Field of the Invention

The invention relates to a winding device for winding a web-shaped material, and a method of changing a reel in a winding device .

2. Description of Related Art

Winding devices conforming to their genre comprise a reel for receiving the web-shaped material. This material is fed over a contact roller to the current reel and is pressed against the reel. Often the contact roller is rotatable, but is otherwise mounted on the machine frame of the winding device in such a way that said contact roller is stationary.

When the current reel is completely wound, a new reel has to be available for the next phase of the winding process. The new, still empty reel is advanced to the web-shaped material. Since the web shaped material and the still empty reel attract each other no later than upon direct contact (for this purpose there is, for example, a double-sided adhesive tape on the still empty reel; or an electrostatic charging is used for this purpose), the web-shaped material has to be severed at the appropriate moment. Generally this so-called pre-winding process occurs while the still empty reel is engaged at the contact roller or shortly after the still empty reel was engaged at the contact roller.

In this context a still empty reel consists of a reel shaft and usually a reel core, which has been slid onto the reel shaft. The reel core forms together with the wound material the core. In principle, it is also possible to wind without a reel core.

In this case a still empty reel is often stored in a reel magazine. When the reel is to be changed, an empty reel is removed from the magazine and conveyed to the contact roller by means of a device for feeding the still empty reel to the contact roller until said empty reel touches the contact roller. At that moment the reel is taken by a retaining device and usually connected to a reel drive, so that the reel, which at this point has already taken up the web-shaped material, can rotate at its own defined circumferential speed. However, it is also possible to let the reel be driven solely by the contact roller.

In order to be able to carry out a reel change in the correct way and in order to obtain in the end a winding of high quality, the still empty reel is driven in rotation. In this case said empty reel is often speeded up until its circumferential speed is equal to more or less the circumferential speed of the contact roller.

In actually existing winding devices of the applicant the rotary drive of the still empty reel is effected by a driven gear that is mounted on the periphery of the reel, usually in the region of its pin. If however, the still empty reel is fed to the contact roller, then this contact is released and the reel shaft rotates freely. If at this point this feeding takes a relatively long time, then the rotational motion of the reel has often slowed down, so that its circumferential speed is often significantly less than the circumferential speed of the contact roller. As a result, the conditions for proper pre-winding are often no longer met.

Therefore, the object of the present invention is to further develop the known winding device in such a way that these disadvantages are avoided.

SUMMARY OF THE INVENTION

According to the invention, this object is achieved by the features described herein. Accordingly, it is also provided in a device having a contact roller for feeding and pressing a web-shaped material against a reel, a device for rotationally driving the reel while empty, and a device for feeding the reel while empty to the contact roller, that the device for rotationally driving the still empty reel and the device for feeding the still empty roll to the contact roller are able to act simultaneously on the still empty reel.

In other words, even in the course of feeding the still empty reel to the contact roller, the device for rotationally driving the still empty reel acts on said still empty reel. As a result, most of the time a torque is applied to the still empty reel, so that said empty reel is not held in a manner allowing it to rotate freely. Therefore, its rotational speed is controllable and can be adjusted in such a way that its circumferential speed is equal to the circumferential speed of the contact roller. Now it is possible to pre-wind this new, still empty reel without any loss of quality.

In an advantageous embodiment the device for rotationally driving the still empty reel comprises power transmission means, which act on a gearwheel, which is arranged on the reel shaft of the reel. Reel shafts, which have already been used in winding devices according to the prior art, generally have a gearwheel, by means of which this reel can be driven during the winding operation. Therefore, it is advantageous to allow the device for rotationally driving the still empty reel to act on this gearwheel, so that the result is a more reliable drive. In contrast, the prior art device for rotationally driving comprised only a power transmission that worked according to the principle of a frictional engagement, where in this case, for example, there may be an incomplete transmission of power, if dirt has settled on one of the components involved. Now the power transmission means shall comprise components that mesh with the gearwheel described above or with another gearwheel, so that slip is prevented. The gearwheel of the reel is arranged preferably on a pin of the reel, i.e., in the area, in which there is no reel sleeve.

In an additional advantageous embodiment of the invention, the device for rotationally driving the still empty reel comprises power transmission means, which are at least partially elongated. The direction of extension of this elongated member extends preferably parallel to the direction of travel of the device for feeding the still empty reel to the contact roller, so that the basic idea of the invention can be implemented in a simple way.

At the same time it is advantageous for the power transmission means to comprise at least one sprocket chain and/or one toothed belt. With these means it is very easy to produce or interrupt a power transmission between the device for rotationally driving the still empty reel and the reel. The said means are mechanically flexible and "slip" into the teeth of the gearwheel, without causing excessive wear.

Furthermore, it is advantageous if the device for rotationally driving the still empty reel comprises its own drive, which is preferably designed as an electric motor.

In another embodiment of the invention the device for rotationally driving the still empty reel comprises at least one retaining element, which can be moved, preferably pivoted, relative to the machine frame of the winding device. This retaining element is used to establish or interrupt in a simple way the drive connection between the device for rotationally driving and the reel.

In this respect it is preferably provided that force transmission means and/or the drive is and/or are arranged on the at least one retaining element. An arrangement of this type is mechanically simple to design and has a high reliability. If the power transmission means and the drive are arranged on the retaining element, then only the power cables, required to transmit the energy, have to be designed in such a way that they join in the movement of the retaining element, a feature that is usually not a problem.

In an additional embodiment the at least one retaining element can be moved by means of at least one actuator. Preferably this actuator comprises a pneumatic or hydraulic cylinder. Then these cylinders are parts of a reciprocating piston cylinder unit, so that they are simple in design and, therefore, inexpensive. In addition, neither large adjustment ranges nor precise positioning is required.

In another advantageous embodiment of the invention, at least one sensor is provided. This sensor can be used to output a signal, when the still empty reel has reached or undershot a specified distance from the contact roller. This distance is very small and is in the range of up to two centimeters. The signal is used to move the device for rotationally driving the still empty reel away from the reel. In other words, this design achieves the objective that the drive connection between the device for rotationally driving the still empty reel and the reel is interrupted, before the reel comes into contact with the contact roller and/or the web of material to be wound. Although the reel rotates for a very short period of time without any positive drive system and, thus, freely, the reduction in speed, which is barely present, has no effect on the quality of the new reel.

The aforementioned object is also achieved by means of a method of changing a reel as described herein. In this case the reel change is based on a method, in which

- a reel for receiving the web-shaped material is provided,
- the web-shaped material is fed to and pressed against the reel with a contact roller,
- a still empty reel is rotated and held with a device for rotationally driving, and
- the still empty reel is moved in the direction of the contact roller with a device for feeding the still empty reel to the contact roller.

The method according to the invention is now characterized in that the device for rotationally driving the still empty reel and the device for feeding the still empty reel to the contact roller act simultaneously on the still empty reel.

The features and combinations of features that are described in conjunction with the winding device of the invention can also be combined with the inventive method. This also applies in reverse, so that in conjunction with the disclosure of individual features of the invention, reference may always be made or is always made to them alternately.

BRIEF DESCRIPTION OF THE DRAWINGS

Additional exemplary embodiments of the invention will become apparent from the description of the subject matter and the claims.

The individual figures show in.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
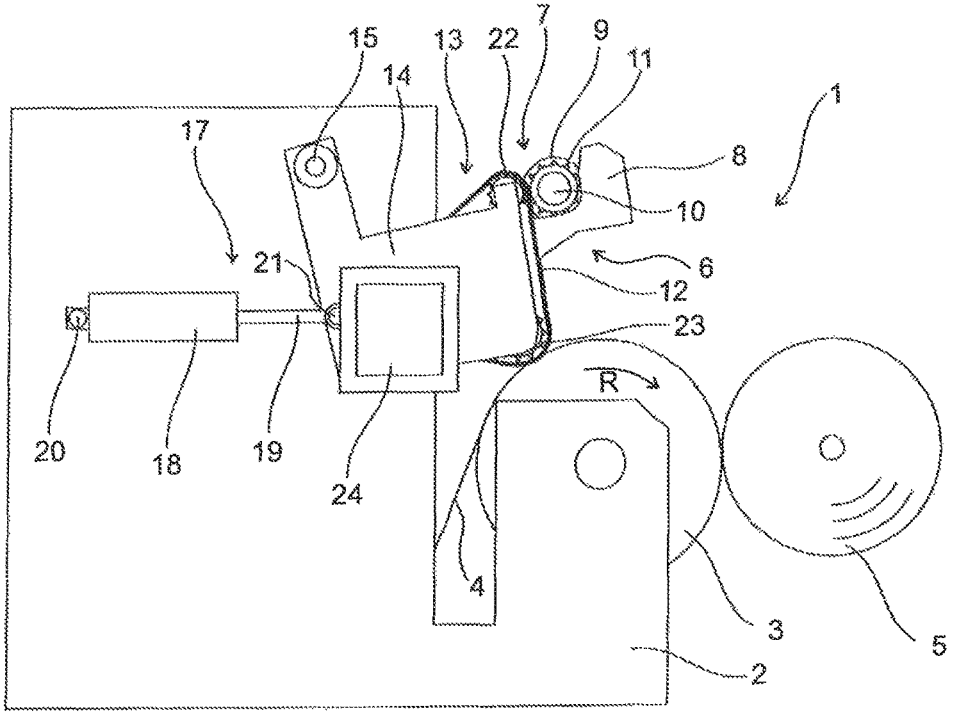
FIG. 1 in schematic form a side view of a winding device, according to the invention.
Figure 2:
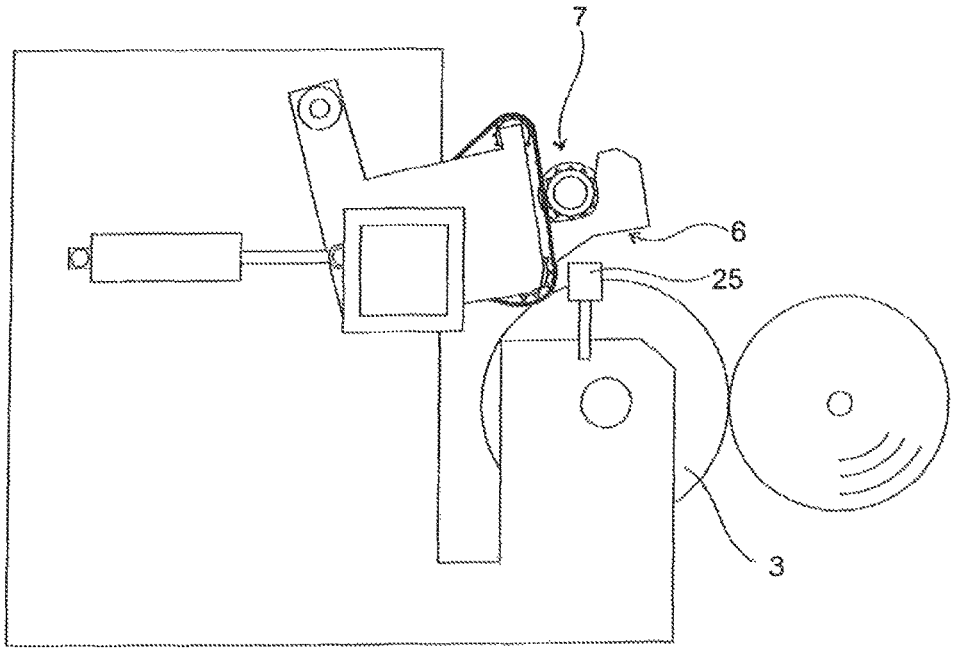
FIG. 2 a winding device, as shown in FIG. 1, but in a still empty reel while being fed to the contact roller.
Figure 3:
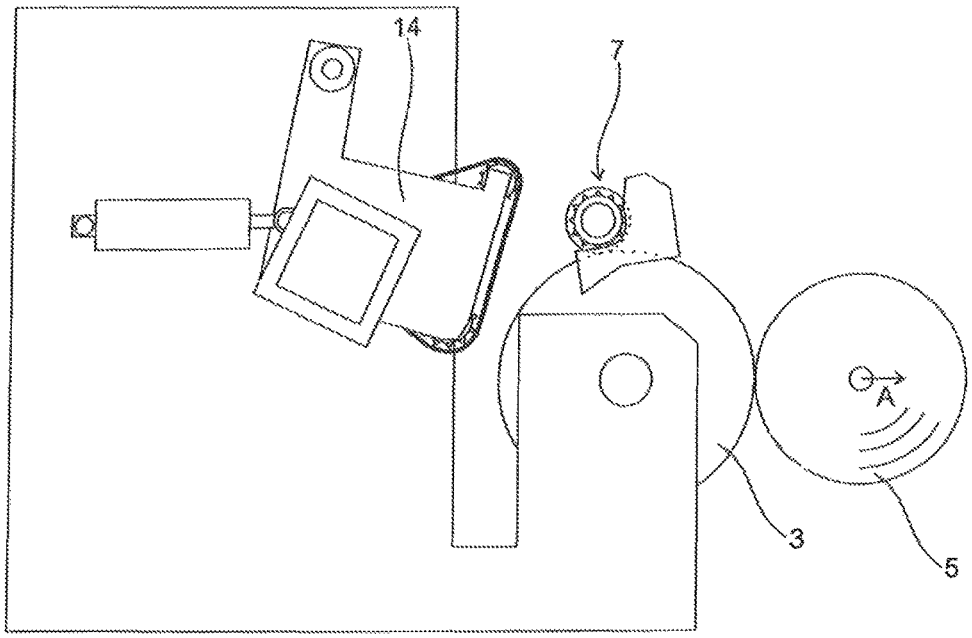
FIG. 3 a winding device, as shown in FIG. 2, but with the reel already engaged and the device for rotationally driving swung away.

FIGS. 1 to 3 show in schematic form the same side view of a winding device 1 of the invention. This winding device comprises a machine frame 2 and a contact roller 3, which is mounted on the machine frame in such a way that it can be rotated in said machine fame; and said contact roller is rotated in the direction of rotation R. A web-shaped material 4 is fed over this contact roller 3 and then wound on a reel 5.

A displacement device 6, which is used to feed a still empty reel 7 to the contact roller 3, can be moved, preferably linearly, relative to the machine frame and relative to the contact roller in a manner that is not shown in more detail. In FIG. 1 this displacement device 6 is in its home position. The reel 7 was supplied from a reel magazine (not shown) and is now resting on the support device 8.

The reel 7 comprises a reel sleeve 9, for example, a paper sleeve, a pin 10 and a gearwheel 11 disposed on said pin.

In FIG. 1 the gearwheel 11 is in engagement with the toothed belt 12 of the device 13 for rotationally driving the still empty reel. The toothed belt 12 is preferably a double toothed belt; that is, it comprises teeth on both sides.

Furthermore, this device 13 comprises a retaining plate 14, which is fastened to the machine frame 2 in such a way that it can be pivoted about the bearing 15. Designed as a pivot drive is a reciprocating piston cylinder unit 17, comprising a cylinder 18, which is hinged to the machine frame 2 by means of the pivot bearing 20, and a piston 19, which is hinged to the retaining plate 14 by means of the pivot bearing 21.

Arranged on the retaining plate 14 are at least the gearwheels 22 and 23, which are arranged and/or dimensioned in such a way that the toothed belt 12 runs, as already described above, parallel to the displacement device 6. Additional gearwheels and pulleys may be provided. The toothed belt 12 is driven by an electric motor 24, which acts preferably by way of a driving gearwheel on the toothed belt 12 in a manner that is not shown. The electric motor 24 is mounted on the retaining plate 14.

FIG. 2 shows the same view as in FIG. 1, but the displacement device 6 has already been advanced a little towards the contact roller 3. This FIG. 2 does not show all of the reference numerals, since all of the components match more or less the components shown in the drawing in FIG. 1. However, this figure shows a sensor 25 that is used to determine whether the still empty reel 7 has already reached or dropped below a specified minimum distance from the contact roller 3.

FIG. 3 shows once again all of the components that have already been explained in conjunction with FIG. 1. However, in this figure the reel 7 is already in contact with the contact roller 3, so that the reel change has just been completed or can be done. The retaining plate 14 with all of its attachments has already been swung away, so that the device 13 no longer acts on the reel 7. The now finished reel 5 was moved or will be moved in the direction A and, in so doing, moved away from the contact roller 3. This reel 5 can now be removed.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Numerals and Characters

| | |
|---|---|
| 1 | winding device |
| 2 | machine frame |
| 3 | contact roller |
| 4 | web-shaped material |
| 5 | reel |
| 6 | displacement device |
| 7 | empty reel |
| 8 | support device |
| 9 | reel sleeve |
| 10 | pin |
| 11 | gearwheel |
| 12 | toothed belt |
| 13 | device for rotationally driving |
| 14 | retaining plate |
| 15 | bearing |
| 16 | |
| 17 | piston cylinder unit |
| 18 | cylinder |
| 19 | piston |
| 20 | pivot bearing |
| 21 | pivot bearing |
| 22 | gearwheel |
| 23 | gearwheel |
| 24 | electric motor |
| 25 | sensor |
| R | direction of rotation of the contact roller 3 |
| A | direction of removal of the finished reel 5 |

What is claimed is:

1. A winding device for winding a web-shaped material, said winding device comprising:

a reel for receiving the web-shaped material;

a contact roller for feeding and pressing the web-shaped material against the reel;

a device for rotationally driving the reel while empty; and a device for delivering the reel while empty to the contact roller, the device for rotationally driving the empty reel and the device for delivering the empty reel to the contact roller being configured to act simultaneously on the empty reel, with the rotational speed of the empty reel being controlled such that a circumferential speed thereof is equal to the circumferential speed of the contact roller as the empty reel is delivered, and with the rotational driving being terminated before the delivered empty reel contacts at least one of the contact roller and the web-shaped to be wound.

2. The winding device, as claimed in claim 1, wherein the device for rotationally driving the empty reel includes a power transmission device that acts on a gearwheel, which is arranged on a reel shaft of the reel.

3. The winding device, as claimed in claim 2, wherein the power transmission device includes at least one of a sprocket chain and a toothed belt that cooperates with the gearwheel.

4. The winding device, as claimed in claim 2, wherein the device for rotationally driving the empty reel includes a retaining element, which is movable, relative to a machine frame of the winding device.

5. The winding device, as claimed in claim 4, wherein the power transmission device is arranged on the retaining element.

6. The winding device, as claimed in claim 3, wherein the retaining element is movable by an actuator.

7. The winding device, as claimed in claim 6, wherein the actuator includes a pneumatic or hydraulic cylinder.

8. The winding device according to claim 4, wherein the movable retaining element is pivotable.

9. The winding device, as claimed in claim 1, wherein the device for rotationally driving the empty reel includes a power transmission device that is at least partially elongated in shape so as to extend parallel to a direction of travel of the device for delivering the empty reel to the contact roller.

10. The winding device, as claimed in claim 1, wherein the device for rotationally driving the empty reel includes a separate drive.

11. The winding device, as claimed in claim 1, further comprising a sensor with which a signal is communicated when the empty reel has reached or undershot a specified distance from the contact roller.

12. The winding device according to claim 1 , wherein the web-shaped material is a plastic film.

13. A method of changing a reel in a winding device for winding a web-shaped material, said method comprising the following steps:

feeding the web-shaped material to a reel for receiving the web-shaped material, and pressing, with a contact roller, the web-shaped material against the reel;

rotating the reel, while still empty, with a device for rotationally driving the reel;

moving the empty reel in a direction of the contact roller with a device for delivering the empty reel to the contact roller, with the device for rotationally driving the empty reel and the device for delivering the empty reel to the contact roller acting simultaneously on the empty reel;

controlling the rotational speed of the empty reel such that a circumferential speed thereof is equal to the circumferential speed of the contact roller as the empty reel is delivered; and terminating the rotational driving before the delivered empty reel contacts at least one of the contact roller and the web-shaped material to be wound.

14. The method according to claim 10, wherein the web-shaped material is a plastic film.

15. The method according to claim 10, further comprising a step of determining with a sensor when the empty reel has reached or undershot a specified distance from the contact roller, and issuing a signal from the sensor.

16. A winding device for winding a web-shaped material, said winding device comprising:

a reel for receiving the web-shaped material, the reel including a reel shaft and a gearwheel associated therewith;

a contact roller for feeding and pressing the web-shaped material against the reel;

a device for rotationally driving the reel while empty, including a power transmission device having at least one of a sprocket chain and a toothed be that cooperate with the gearwheel so as to establish or to interrupt the rotational driving ; and a device for delivering the reel while empty to the contact roller, the device for rotationally driving the empty reel and the device for delivering the empty reel to the contact roller being configured to act simultaneously on the empty reel.

17. The winding device according to claim 16, wherein the device for rotationally driving the empty reel includes a retaining element, which is movable, relative to a machine frame of the winding device.

* * * * *